United States Patent [19]

Ohanian

[11] 4,328,992

[45] May 11, 1982

[54] ADJUSTABLE FOOT STOOL

[76] Inventor: Walter Ohanian, 42 E. Bel Aire Rd., Cranston, R.I. 02920

[21] Appl. No.: 161,766

[22] Filed: Jun. 23, 1980

[51] Int. Cl.[3] ..... A47C 7/50

[52] U.S. Cl. ..... 297/439; 108/118; 248/164; 248/421

[58] Field of Search ..... 297/18, 56, 461, 441, 297/457, 439, 438, 421; 248/164, 431, 432; 108/118, 119, 120; 192/43.1

[56] References Cited

U.S. PATENT DOCUMENTS

| | | | |
|---|---|---|---|
| 1,011,585 | 12/1911 | Creasey | 108/64 |
| 1,506,464 | 8/1924 | Alten | 297/441 X |
| 2,987,109 | 6/1961 | Sohmer | 248/164 X |
| 3,182,614 | 5/1965 | McLean | 108/118 |
| 3,196,465 | 7/1965 | Montgomery | 108/118 X |
| 3,467,231 | 9/1969 | Haznar | 192/43.1 |
| 4,128,152 | 12/1978 | Tschursch | 248/421 X |

FOREIGN PATENT DOCUMENTS

| | | | |
|---|---|---|---|
| 411974 | 4/1925 | Fed. Rep. of Germany | 297/441 |
| 392153 | 5/1933 | Fed. Rep. of Germany | 297/441 |
| 711511 | 6/1931 | France | 297/441 |
| 252491 | 6/1926 | United Kingdom | 297/441 |
| 526027 | 9/1940 | United Kingdom | 297/411 |

*Primary Examiner*—James T. McCall
*Attorney, Agent, or Firm*—Barlow & Barlow

[57] ABSTRACT

An adjustable foot stool is disclosed which embodies a pair of legs that are pivoted to each other, and which carry at their upper ends a flexible member that is fixedly attached to one pair of legs, the other pair of legs carrying a revolvable roller to which the flexible member is attached, the revolvable roller being provided with means to control its position and in turn the position of the legs relative to each other so that the height of the foot stool may be readily adjusted.

3 Claims, 6 Drawing Figures

ADJUSTABLE FOOT STOOL

BACKGROUND OF THE INVENTION

Adjustable stools in the form of seating devices in which the position of the legs may be adjusted height wise are known in the art and are exemplified as for example in U.S. Pat. No. 1,011,585. In this construction the seat portion which is fabric or the like is attached at the upper ends of one pair of legs which the other end passes over a cross member that is positioned at the upper end of the other pair of legs and thence downwardly to engage a plurality of notches. It is desirable in many instances to have an arrangement where the likelihood of disengaging of the notches is prevented.

SUMMARY OF THE INVENTION

The invention is directed to an adjustable foot stool which has two pairs of legs that are pivotally connected to each other with a flexible member attached to the upper end of one pair of legs, while the upper end of the other pair of legs has a revolvable roller therebetween, which revolvable roller has the other end of the flexible member attached thereto with the flexible member being rolled up thereon to control the position of the roller. A releasable means are provided which in the preferred form take the structure of a reversing ratchet. The reversing ratchet may be readily controlled by a rotatable bolt that moves a pair of yieldable pawls and in this way the amount of fabric or flexible material that is rolled up on the roller may be readily controlled, which in turn controls the angle of the pairs of legs and in turn the height of the stool.

DESCRIPTION OF THE PREFERRED EMBODIMENT

Figure 1:
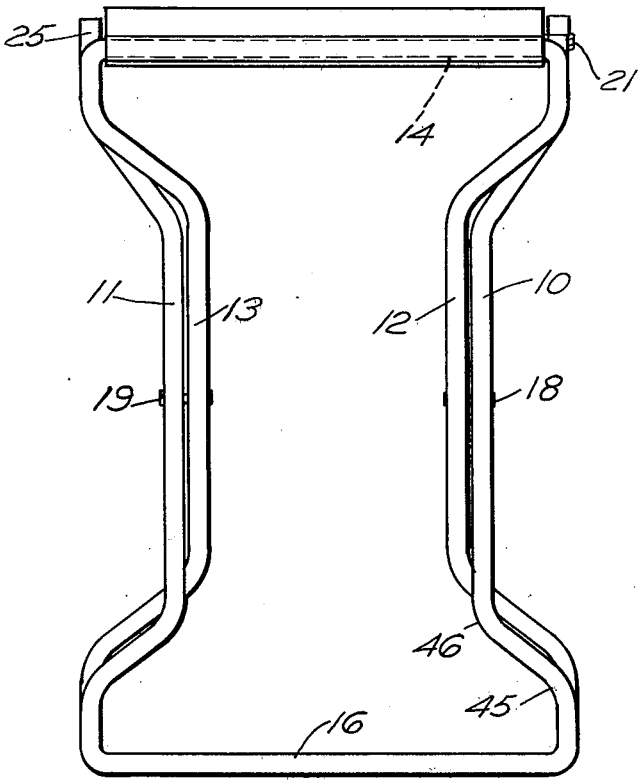
FIG. 1 is an elevational view of the adjustable foot stool in a closed position.
Figure 2:
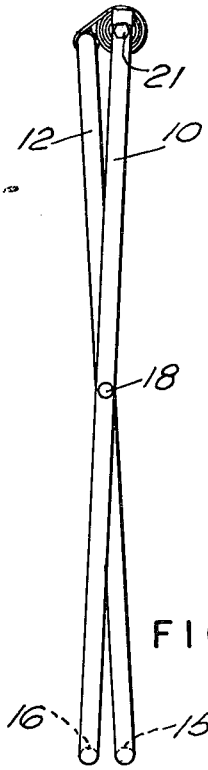
FIG. 2 is an end view thereof.
Figure 4:
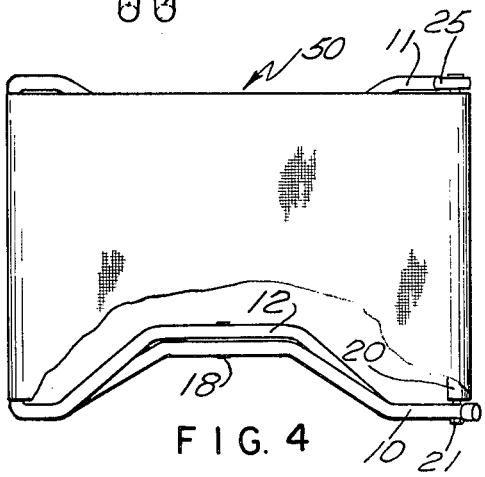
FIG. 4 is a top view of the foot stool on a reduced scale.

As seen in FIGS. 1 and 2 there are two pairs of supporting legs comprising legs 10, 11 and 12, 13. The leg pairs 12 and 13 are joined together by a bar at the upper end thereof designated 14 and may be formed in a suitable fashion so that in some instances a lower bar such as 15 may also be provided. In a similar fashion the leg pairs 10 and 11 may be joined together at their lower end by a bar 16 while at the upper end the roller 20, as seen better in FIG. 4, is provided, the roller having a suitable stub shaft 21 that passes into the upper end of the leg 10 while at the other end a ratcheting mechanism designated 25 is received, having an enlarged casing 26 with a reduced shaft end 27 that may be received in the upper end of leg 11. The leg pairs are centerally pivoted to each other by pivot pins 18, 19.

The ratcheting mechanism is of conventional structure being shown and described in more detail as for example in U.S. Pat. No. 3,467,231, which is incorporated herein by reference; but briefly has an internal tooth recess with one or more pawls such as 28, 29 that will engage the tooth recess. The pawls are pivoted on studs 30, 31 which may connect with an extending stub shaft member 32 (see FIG. 5) and the position of the pawls relative to the housing may be changed by a turn bolt 35 which rotates a central member 36 that has spring loaded detent balls 37, 38 thereon, which when rotated will reverse the pawl position as shown in FIG. 6. The pawls, and in turn, the stub shaft such as 32 will rotate in the direction of the arrow 40.

Figure 3:
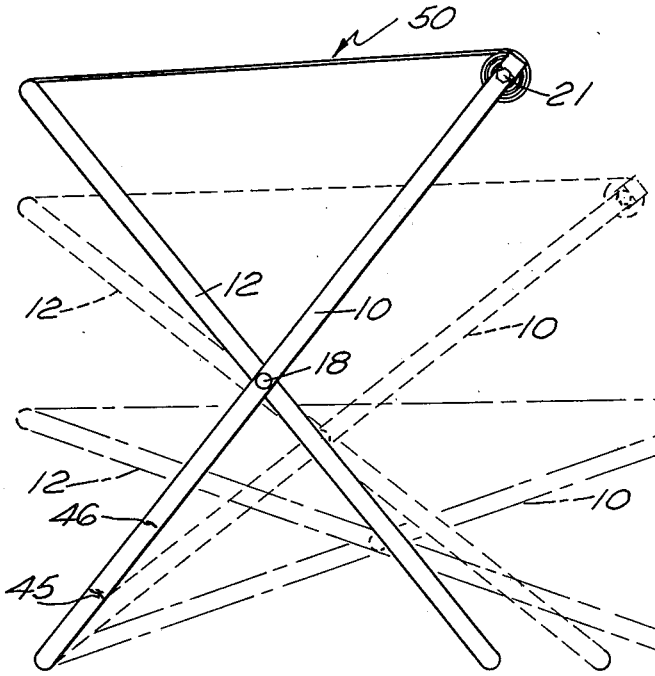
FIG. 3 is a side view of the foot stool showing in dotted lines the manner in which the foot stool may be adjusted.
Figure 5:
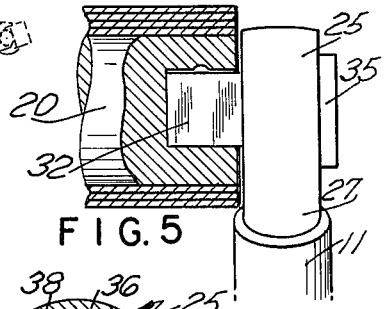
FIG. 5 is an enlarged partial sectional view showing the manner of connection of the roller and the ratcheting device.
Figure 6:
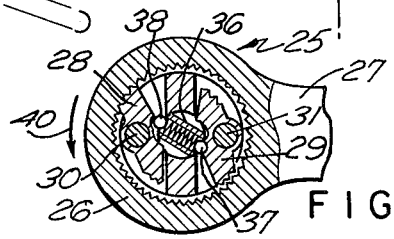
FIG. 6 is a sectional view taken through the ratcheting device showing one form of construction thereof.

The roller 20 as seen more particularly in FIG. 5 may have several layers of flexible material or fabric wound thereon and it will be readily appreciated that the roller may be turned by hand after first adjusting the proper position of the pawl position member 35 so as to ratchet the fabric into the proper position by winding further layers of fabric thereon. When it is desired to unwind the fabric, the member 35 will have its position changed, and in turn the pawl positions will change and permit the fabric to be unwound therefrom and thence locked in position by merely reversing the bolt 35. In this way the various positions of the stool, as seen diagramatically in FIG. 3, may be attained.

In addition to the basic adjustable structure described above, the pairs of legs 10, 11, 12 and 13 may be uniquely formed by being bent inwardly toward each other, as for example by reverse bends at 45, 46, which have been designated purely by way of example, it being understood that similar reverse bends are provided not only at the lower end of leg 10, but also at the upper end, as well as on legs 11, 12, and 13. Referring now to FIG. 4 of the drawings where a top view of the adjustable foot stool is shown, it will be apparent that when the device is utilized as a foot stool and one rests his limbs thereon from a point external to the adjustable stool, the flexible material or fabric as in the area designated generally 50 will tend to bend or deflect downwardly. If the legs 10, 11, 12 and 13 were merely straight legs, this bending of the flexible material or fabric would strike the legs and the user of the device would find that it would be uncomfortable as the limbs would be resting directly upon the solid leg structure, rather than on the flexible soft member.

I claim:

1. An adjustable foot stool comprising two pairs of legs, each of said pairs being connected together at the upper end thereof, said legs being pivotally connected together, a flexible member attached to the upper end of one pair of legs, the upper end of the other pair of legs being connected together with a revolvable roller, said roller having a manually reversable ratchet affixed thereto to releasably change its direction of free rotation, the other end of the flexible member attached to said roller whereby the roller may be freely rotated to unwind the flexible member and then locked in position by manually changing the free rotative direction.

2. A stool as in claim 1 wherein the lower ends of said pairs of legs are connected together.

3. A stool as in claim 1 wherein the intermediate portion of the legs are bent inwardly toward each other.

* * * * *